US006977114B2

(12) United States Patent
Crum

(10) Patent No.: US 6,977,114 B2
(45) Date of Patent: Dec. 20, 2005

(54) COMMUNICATION SUBSTRATES HAVING VARIABLY APPLIED FERROMAGNETIC MATERIAL, FERROMAGNETIC COMPOSITION AND A SYSTEM AND METHOD OF APPLYING THE MATERIAL TO A SUBSTRATE

(75) Inventor: Jesse D. Crum, Fort Scott, KS (US)

(73) Assignee: Ward/Kraft, Inc., Fort Scott, KS (US)

( * ) Notice: Subject to any disclaimer, the term of this patent is extended or adjusted under 35 U.S.C. 154(b) by 0 days.

(21) Appl. No.: 10/649,449

(22) Filed: Aug. 26, 2003

(65) Prior Publication Data

US 2005/0046176 A1 Mar. 3, 2005

(51) Int. Cl.[7] ..... B42D 107/00
(52) U.S. Cl. ..... 428/323; 428/336; 428/692; 428/693
(58) Field of Search ..... 428/336, 692, 428/693, 323

(56) References Cited

U.S. PATENT DOCUMENTS 3,052,564 A * 9/1962 Kulesza ..... 427/550
3,054,751 A * 9/1962 Blake et al. ..... 252/62.53
3,108,824 A * 10/1963 Fischer et al. ..... 283/56
3,566,356 A * 2/1971 Holm et al. ..... 235/449
3,758,970 A * 9/1973 Annenberg ..... 283/82
3,895,220 A * 7/1975 Nelson et al. ..... 235/493
4,658,125 A * 4/1987 Kachi et al. ..... 235/449
5,843,329 A * 12/1998 Deetz ..... 252/62.54
6,432,520 B2 * 8/2002 Pynenburg et al. ..... 428/195.1
6,693,506 B2 * 2/2004 Matsumura et al. ..... 336/200

* cited by examiner

*Primary Examiner*—Stevan A. Resan
(74) *Attorney, Agent, or Firm*—Michael C. Maier

(57) ABSTRACT

The present invention relates generally to substrates intended for business and other communications such as marketing, advertising and personal communications as well as, intermediates, materials, documents or the like related thereto and more particularly to business and marketing communication documents having a variably applied or imaged ferromagnetic material suitable for use in accentuating a message, marketing theme or event. In addition, the present invention describes the method of using the ferromagnetic material as well as the composition suitable for use with the present invention.

4 Claims, 2 Drawing Sheets

COMMUNICATION SUBSTRATES HAVING VARIABLY APPLIED FERROMAGNETIC MATERIAL, FERROMAGNETIC COMPOSITION AND A SYSTEM AND METHOD OF APPLYING THE MATERIAL TO A SUBSTRATE

CROSS-REFERENCES TO RELATED APPLICATIONS

None.

FIELD OF THE INVENTION

The present invention relates generally to substrates intended for business and other communications such as marketing, advertising and personal communications as well as, intermediates, materials, documents or the like related thereto and more particularly to business and marketing communication documents having a variably applied, printed or imaged ferromagnetic material suitable for use in accentuating a message, marketing theme or event, advertising or the like. In addition, the present invention describes the method of using the ferromagnetic material as well as the composition suitable for use with the present invention and the system for applying the material to the communication substrate.

BACKGROUND OF THE INVENTION

Ferromagnetic materials or magnets as they are more commonly known have heretofore been used in a wide variety of applications and are often given away as part of a promotional offering or the like. For example, magnets have been applied to calendars, detachable reference cards, commercial services, restaurants, emergency numbers and the like.

More recently, however, ferromagnetic materials, magnets, have been used in connection with providing business cards, advertising collateral and the like and can be attached to card stock and other substrates. Such products, particularly those intended for small office or home office ("SOHO") have been pre-printed with indicia related to the SOHO application. Other products are intended for larger commercial distribution and may be manufactured in connection with a national food delivery service. However, the level of personalization, if any has been extremely limited.

Alternatively, where such installations or applications permit, magnets can be provided in a blank format thereby enabling the SOHO user to provide some level of personalization, such as a phone number or name to the magnet prior to distributing the magnet, such as through promotional giveaways, direct mail offerings and other solicitations and the like. However, there still has not been a significant amount of personalization available for such products.

Unfortunately, such magnetic material products typically require that the magnetic material usually be "tipped on" the material or may form part of a laminate during the construction of the form assembly. Such magnetic material is normally supplied in a sheet form, which is then cut to the intended size and then either juxtaposed on top of the substrate and adhered or connected to the substrate through the use of a bridge or adhesive securement. Each of these forgoing arrangements regrettably results in a substrate having a differing thickness either between the substrate and the magnetic material or in the area of the attachment or bridge thereby creating a "bump" in the construction which can be difficult to process through printers or other imaging devices or sheet feeding equipment.

The result of such differing thickness or bumps in the construction can create feeding problems as the sheet on which the magnetic material is applied or the bridge connecting the magnet to the substrate is higher or extends upwardly a distance greater than the distance of the substrate itself. As such, a desktop or other printer when encountering such bumps may jam as the thickness of the construction is to significant or large to fit within the nip of the feed rollers of the printer.

Alternatively, if the printer is able to advance the form construction, that is the printer feed rollers can grasp and advance the leading edge of the form, the form may subsequently splay out of alignment with the direction of travel as a portion of the leading edge will likely advance ahead of the remainder of the form. This unfortunately causes the image to appear either in an unintended portion of the form or at the very least the printing will likely be skewed away from the intended alignment of the magnet attached or connected to the form.

What is therefore needed is a highly personalizable substrate that can be used as a business, marketing, advertising or personal communication piece that overcomes the foregoing drawbacks while enabling the recipient to have a magnetic component, which may be detachable, to call to mind the communication being supplied to the recipient in a convenient to use manner.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention provides a communication substrate having a magnetic portion which does not suffer from the drawbacks referenced above, in that the magnetic material does not rise above the surface of the substrate a significant height so as to interfere with the operation of the printer, imaging or other sheet feeding device or document handling equipment.

In one embodiment of the present invention a business, personal or marketing communication piece is described and includes a substrate having first and second faces, first and second longitudinally extending side edges and first and second transversely extending end edges. One of the first and second faces of the substrate is capable of receiving a ferromagnetic material and non-ferromagnetic indicia. The ferromagnetic material is applied to the substrate in a variable pattern through use of printing or imaging rollers to create a communication piece having a magnetic portion that is printed or imaged directly on to the substrate as well as a non-magnetic portion. Each of the imaged or printed portions cooperated to convey information to the recipient, and the magnetic portion has a thickness of less than 25 mils.

In a still further embodiment of the present invention method of communicating a variable marketing or business message is described and includes a ferromagnetic component. The method of the present invention includes the steps of initially, providing a substrate that is capable of receiving both ferromagnetic and non-ferromagnetic indicia. Then creating a message for communicating to a pre-selected recipient based on information received from a pre-existing database or in response to a particular informational demand or other demographic. The substrate is then advanced to at least a first printing area for printing a ferromagnetic component of the message. The message is then transferred to the substrate through the use of cooperating rollers. Finally, the substrate is moved through at least one curing station to cure the ferromagnetic component of the message.

In a yet still further embodiment of the present invention a ferromagnetic slurry for use in creating indicia for a communication document is described and includes a ferrite power provided in an amount ranging from about 50 to about 90% by weight of the slurry and more preferably from about 50 to about 70% by weight; a stabilizer provided in an amount ranging from about 5 to about 20% by weight of the slurry; a varnish provided in an amount ranging from about 15 to about 30% by weight of the slurry and the slurry is curable.

In yet a still further embodiment of the present invention a system for creating a substrate having a ferromagnetic portion and a non ferromagnetic portion each of which are applied directly to the substrate is described and includes a reservoir containing a ferromagnetic slurry; a series of cooperating rollers for transferring a predetermined pattern formed from the ferromagnetic slurry to the substrate to create a ferromagnetic image; and at least first and second curing stations for curing the ferromagnetic image applied to the substrate with each of the first and second curing stations curing a different portion of the ferromagnetic image.

The foregoing embodiments will be further clarified by reference to the following sections and figures.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
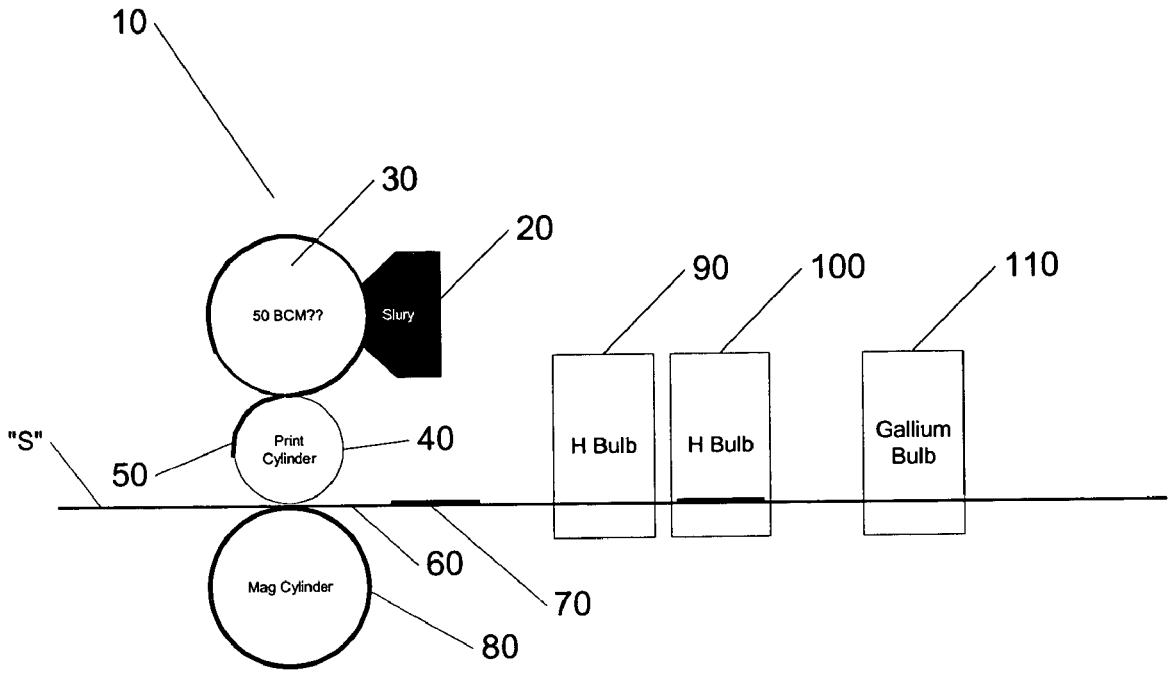
FIG. 1 depicts a schematic of the present invention and the method of making the form construction contemplated herein.

The present invention is now illustrated in greater detail by way of the following detailed description, but it should be understood that the present invention is not to be construed as being limited thereto.

Surprisingly, it has been found that certain ferromagnetic material can be supplied in a slurry to a print deck through use of a printing reservoir so that a variably applied, unique image can be created on a plurality of substrates.

The present invention overcomes the foregoing drawbacks in that the ferromagnetic or magnetic material is imaged, printed or applied directly onto the surface of the substrate and is not applied as a separate and distinct magnet that rises substantially above the surface of the substrate. That is, the ferromagnetic material that is applied in accordance with the present invention does not rise significantly above the surface so that there is no bump or other interference to interrupt the flow of the substrate through a printer or other handling equipment.

The term substrates as used herein include but are not limited to cellulosic-based materials such as card stock, corrugated material, paper as well as plastic and other films, and combinations thereof. Substrates include generally planar substrates. Substrates also include finished substrates, those to which printing or other ancillary items have been attached, such as labels, cards and tags as well as substrates that are provided in an intermediate form and which undergo a further processing step such as printing, cutting, adhering, folding, sealing or the like prior to being delivered, such as through the mail service, to an end user or recipient.

The message that is produced in accordance with the present invention may be obtained from a data base related to marketing, advertising, business or personal communications to be distributed to recipients or may be in response to informational requests received from a target audience or in connection with other demographics to be addressed by the communication or as part of a general solicitation for business or commercial services.

Application of the magnetic slurry of the present invention may be accomplished by any suitable means such as flexographic, electrostatic, gravure, ion or electronic charge deposition, electro-coagulation printing and the like. Generally, however, printing of the present invention of an exemplary embodiment is done by means of surface tension, whereas the slurry is picked up from the reservoir chamber by the anilox cylinder, in which it is then transferred or pulled by the magnetic section or plate on the print cylinder, and in turn, is then pulled by the mag cylinder which resides underneath the desired substrate. This process creates the corresponding image on top of the substrate residing below the print cylinder. The slurry may also be applied by means of slot die, mirod, blade applicator, and the like, but should be understood as not limited thereto.

The term magnetic or ferromagnetic slurry as used herein, refers to a slurry that is applied in-line during printing operations and undergoes several processing steps prior to reaching its final destination. In one exemplary embodiment of the present invention, the slurry is curable by ultraviolet energy (UV curable) and includes as an exemplary formulation 410 Ferrite Powder, 30 LI Varnish, and a stabilizer additive which gives the invention its unique capability of being able to bind and adhere to substrates during a printing operation.

In one embodiment of the present invention, and exemplary formula breaks includes the following components. Approximately 50–70% of 410 Ferrite Powder by weight of the slurry with about 60–65% by weight being preferred, and about 61–63% by weight being more preferred. Roughly 5–20% of a stabilizer, such as corn starch, by weight of the slurry with approximately 10–15% being preferred and 11–13% being more preferred. A stabilizer, such as corn starch, may include, but is not limited to, low amylose & high amylose corn starches and combinations thereof. Approximately 15–30% by weight of the slurry of 30 LI Varnish with about 20–27% by weight of the slurry being preferred and about 23–26% by weight being more preferred. The 410 Ferrite powder is available from Hoosier Magnetics, Inc., Holland, Ohio; the 30 LI Varnish is available from North West Coatings, Oak Creek, Wis. and the stabilizer, corn starch, is available from National Starch and Chemical Company, Chicago, Ill.

The slurry of the present invention is formulated so that the slurry once coated, applied, printed or imaged on the product is UV curable. Application of the slurry to a substrate, after curing results in a layer of cured ferromagnetic material having a thickness ranging from about 0.5 mil to about 25 mil and more preferably the cured thickness of the ferromagnetic material is in the range of about 1 to about 15 mil thickness and still more preferably in the range of approximately 2 to 12 mil thickness.

UV curing is a technology that regularly evolves and efforts are continually sought out in order to achieve improved curing performance so that the printing operation may proceed at optimum speeds. That is, UV curing typically requires a "dwell time" in which the UV curable substance dries before it can be further processed in any additional equipment. As such, it is preferable to achieve faster curing speeds under a variety of difficult and complex environments so as to minimize if not completely eliminate the need for dwell or drying time.

Turning now to FIG. 1, which shows a schematic illustration of one embodiment of the present invention. The process is generally depicted by reference to numeral 10. A substrate, designated by the reference "S" is drawn from a supply (not shown), which may either be a supply of cut sheet stock or alternatively, a continuous stock such as provided from a roll of material. The substrate "S" is supplied in a machine direction, however, the substrate S may be reversed or travel in an orientation other than a machine direction in order to meet processing or needs related to the manufacture of the form construction to be produced.

Turning now to the function of supplying the ferromagnetic material to the substrate S. A reservoir or well 20 is filled with a ferromagnetic material, as described above (ferrite powder, stabilizer and a varnish). An imaged created with a cylinder, by means of surface tension, 30, the surface tension cylinder helping to create the image configuration, picks up the UV curable magnetic or ferromagnetic slurry from reservoir 20. The magnetic slurry adheres to the roller 30, by the charge, surface tension or other means known in the art.

Next, the roller, 30, transfers the magnetic slurry material to the print cylinder, 40. The print cylinder, 40, has a magnetic plate affixed to the surface of the print cylinder. The magnetic plate, 50, then transfers the magnetic slurry to the desired substrate S now depicted as reference numeral 60. The magnetic slurry now applied to the desired substrate 60 is represented by reference numeral 70.

FIG. 1 further depicts a magnetic cylinder, 80 disposed beneath the substrate S and in operative association with print cylinder 40. The magnetic cylinder, 80, aids in pulling the magnetic slurry 50, to the predetermined position on the substrate 60. The magnetic cylinder, 80, also provides for and maintains a consistent transfer of the UV curable magnetic slurry to the substrate as shown at 70.

Once the magnetic slurry is affixed to the substrate 70, the substrate with the slurry applied 70 then passes through at least one if not additional UV curing stations which contain UV bulbs for curing purposes. The "H" bulbs described below and depicted by reference to numerals 90 and 100, and the Gallium bulb, also described below, is depicted by reference numeral 110.

In practicing an exemplary embodiment of the present invention, as shown in FIG. 1 a series of UV curing bulbs, positioned side by side, adjacent or sequential configuration is used. In an exemplary embodiment, a single bulb may allow a UV cure rate of approximate 50 feet per minute, while plural bulbs disposed in a side-by-side adjacent configuration, permits a higher curing rate of approximately 75 feet per minute. Obviously, other curing station configurations may be used in order to increase the possible through put rate of the equipment and processing of the substrates to be printed.

Exemplary bulbs used in the embodiment depicted in FIG. 1 of the present invention are "H" bulbs and Gallium doped bulb suitable for use in the UV curing processes depicted herein, however, it should be understood that other UV curing may be used in accordance with the present invention and the present invention is not limited hereto.

The "H" bulb is generally known as a mercury vapor bulb and is used typically for top surface curing applications. The Gallium doped bulb is used in connection with a requirement for penetrating deep within the slurry mix. The UV bulbs such as those described above along with reflectors are available from the GEW Company, located in North Royalton, Ohio. The combination of topical and penetration curing result in a combination of curing energies sufficient to carry out the present invention.

The present invention also contemplates additional processing steps (not show) that may include, but are not limited to, one or more additional printing stations such as for applying other indicia. Other operations may include the addition of label, card or tag stock to the construction, cutting, perforating, sheeting, folding, sealing and the like. A product such as with the present invention can be provided in both an intermediate condition, as well as a finished condition so that a customer can have a finished product that accommodates an infinite variety of uses or may further modify the intermediate assembly to add some additional degree of personalization.

Figure 2:
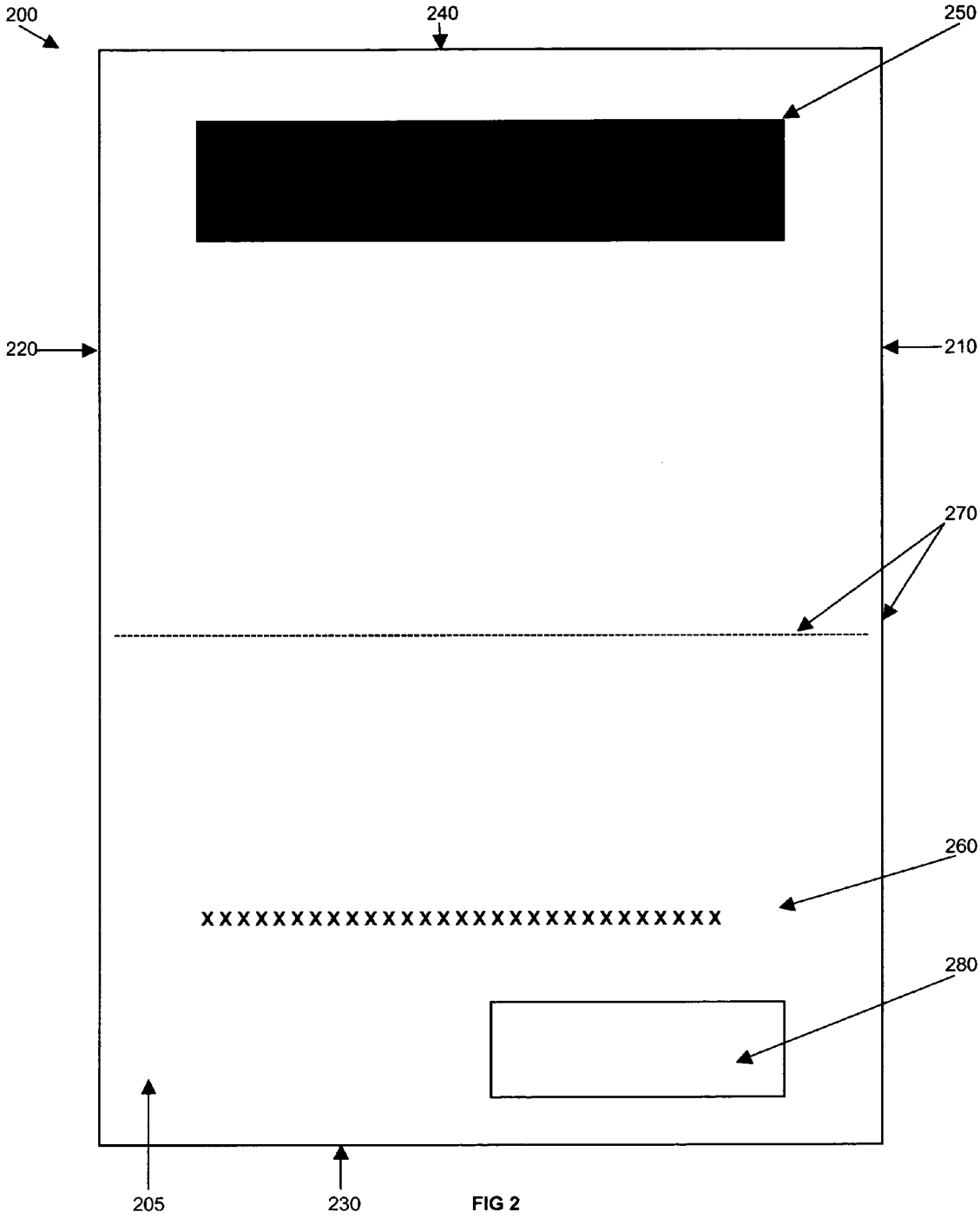
FIG. 2 provides an illustration of an exemplary form produced in accordance with the present invention.

Turning now to FIG. 2, and exemplary embodiment of the product produced in accordance with the present invention is depicted generally by reference to numeral 200. The substrate 200 has a first face 205 and a second face (not shown) which is on the obverse side of the substrate. The substrate 200 has first and second longitudinally extending side edges 210 and 220, respectively and first and second transversely extending end edges 230 and 240, respectively. The substrate 200 is shown with a first printable area that contains the printed magnetic slurry 250 and a second printable area that receives a second type of printing 260. The face 205 is one that is suitable for receiving each of the first and second types of printing. The printable face 205 of the substrate 200 may however also be coated, either entirely or in a spot wise fashion with a tie coating or like material, such as a poly vinyl alcohol so as to better tie or bind the magnetic slurry to the substrate.

The invention also contemplates other features that may be supplemental or ancillary to the main features of the invention, these include but are not limited to perforations or cuts 270 so that the substrate 200 may be separated in to first and second parts and an integrated label or card, depicted as reference numeral 280.

It will thus be seen according to the present invention a highly advantageous process and system for producing a communication piece having a ferromagnetic portion has been provided. While the invention has been described in connection with what is presently considered to be the most practical and preferred embodiment, it will be apparent to those of ordinary skill in the art that the invention is not to be limited to the disclosed embodiment, that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A business, personal or marketing communication piece, comprising;

a substrate having first and second faces, first and second longitudinally extending side edges and first and second transversely extending end edges, said first face receives a variably applied ferromagnetic material provided in a UV curable slurry for use in accentuating a message, marketing theme or event and non-ferromagnetic indicia;

said UV curable slurry including ferrite powder ranging from about 50 to about 90% by weight of said slurry a stabilizer ranging from about 5 to about 20% by weight of the slurry and a varnish ranging from about 15 to about 30% by weight of the slurry; and wherein said ferromagnetic material is applied to said substrate in a variable pattern to accentuate a message, marketing theme or event in order to create a personalized magnetic communication on said substrate through use of printing or imaging rollers to create a communication piece having a variably applied magnetic portion that is printed or imaged directly on to said substrate as well as a non-magnetic portion, each of which convey unique information, and said magnetic portion having a thickness of less than 25 mils.

2. A business or marketing communication piece as recited in claim 1, wherein said variably applied magnetic portion and said non-magnetic portion cooperate to form a single business or marketing communication.

3. A business or marketing communication as recited in claim 1, wherein said ferromagnetic slurry is supplied from a reservoir to create said personalized magnetic communication.

4. A business or marketing communication as recited in claim 1, wherein said thickness of said magnetic portion ranges from about 1 to about 15 mils.

* * * * *